US006334038B1

(12) United States Patent
Kawahara

(10) Patent No.: US 6,334,038 B1
(45) Date of Patent: Dec. 25, 2001

(54) ELECTROPHOTOGRAPH DEVELOPMENT APPARATUS USING MAGNETIC DEVELOPER

(75) Inventor: Ichiro Kawahara, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/667,699

(22) Filed: Sep. 22, 2000

(30) Foreign Application Priority Data

Sep. 29, 1999 (JP) ..... 11-276004

(51) Int. Cl.[7] ..... G03G 15/08
(52) U.S. Cl. ..... 399/274; 399/267
(58) Field of Search ..... 118/261, 653, 118/658; 399/274, 275, 276, 277, 282, 284, 267, 270

(56) References Cited

U.S. PATENT DOCUMENTS 4,936,249 * 6/1990 Tajima et al. ..... 399/275
5,461,465 * 10/1995 Sunaga et al. ..... 399/274
5,781,835 * 7/1998 Okano et al. ..... 399/275

FOREIGN PATENT DOCUMENTS 4-86875 3/1992 (JP) .
5-142938 6/1993 (JP) .
7-199626 8/1995 (JP) .
7-333984 12/1995 (JP) .

* cited by examiner

*Primary Examiner*—Arthur T. Grimley
*Assistant Examiner*—Hoang Ngo
(74) *Attorney, Agent, or Firm*—McGinn & Gibb, PLLC

(57) ABSTRACT

An electrophotograph development apparatus for developing an electrostatic latent image formed on an electrostatic latent image carrier body with magnetic developer includes a developer carrier body having a magnetic roller, and a thin layer forming member for forming the magnetic developer on the developer carrier body into a thin layer. A magnetic pole of the magnetic roller is disposed at a position of a θ degree in an upper stream side relative to a rotational direction of the developer carrier body from a contact point of the thin film forming member and the developer carrier body, and θ is in a range of 0 degree≦θ≦10 degree. A relation between a surface roughness Rz' of the developer carrier body and a surface roughness Rz of the thin layer forming member is represented by −10 μm≦(Rz−Rz')≦5 μm.

12 Claims, 7 Drawing Sheets

ELECTROPHOTOGRAPH DEVELOPMENT APPARATUS USING MAGNETIC DEVELOPER

BACKGROUND OF THE INVENTION

1. Field of the Invention

The present invention relates to an electrophotograph development apparatus, more particularly to an electrophotograph development apparatus for developing an electrostatic latent image formed on an electrostatic latent image carrier body with magnetic developer.

2. Description of the Related Art

Heretofore, an electrophotograph equipment has been used for a printer, a copying machine, a facsimile and the like. As a development apparatus of this electrophotograph equipment, a development apparatus using one component magnetic developer has been used. A variety of systems have been conventionally proposed for the purpose of improving durability of the surface of a developer carrier body used in this development apparatus and an image quality. For example, the gazette of Japanese Patent Laid-Open No. Hei 7-199626 discloses a technology in which with regard to the surface roughness of a developer carrier body, JIS ten-point average roughness thereof is set to Rz 10 $\mu$m or less. Moreover, a technology is disclosed, in which mixed resin including ethylene, ethyl and acrylate is added with ferrite powder, and substance thus obtained is made to serve as a dielectric layer of a developer carrier body, and average surface roughness thereof is formed to be 5 $\mu$m or less, for example, in the gazette of Japanese Patent Laid-Open No. Hei 5-142938. Furthermore, a technology is disclosed, in which on the surface of a developer carrier body, an dielectric layer is formed on the surface of a thin layer forming member for forming a thin layer of developer, and surface roughness thereof is set within a range from 0.02 $\mu$m to 2$\mu$m, in the gazette of Japanese Patent Laid-Open No. Hei 4-086875.

An extrusion amount from a contact point of a thin layer forming member and a developer carrier body to a free edge of the thin layer forming member is illustrated in the gazette of Japanese Patent Laid-Open No. Hei 7-333984. However, a numerical value of the extrusion amount is not described here.

In the conventional electrophotograph development apparatus, even if the surface roughness Rz of the developer carrier body is set to 10 $\mu$m or less, if the surface roughness Rz of the thin layer forming member is not defined, magnetic developer can not be formed into a uniformly thin layer on the developer carrier body, thus causing printing defects such as lowering of a solid black density, occurrence of a void, deterioration of density uniformity and occurrence of white base fog. As printing is repeated, the magnetic developer has been fixed to the thin layer forming member, thus causing other printing defects such as occurrence of a white stripe on a solid black surface and printed dots and occurrence of a black stripe on a white base.

Similarly, even if the surface roughness Rz of the thin layer forming member is set within the range from 0.02 $\mu$m to 2 $\mu$m, if the surface roughness of the developer carrier body is not defined, printing defects similar to the above-described defects occur.

SUMMARY OF THE INVENTION

The object of the present invention is to provide an electrophotograph equipment, in which the printing defects inherent in the conventional electrophotograph development apparatus are solved, magnetic developer formed of a thin layer forming member is made to form a uniformly thin layer and to be charged uniformly on a developer carrier body, a development characteristic of the developer carrier body to an electrostatic latent image carrier body is improved, local fixing of magnetic developer to the thin layer forming member with printing repeated is prevented and a stable supply of the magnetic developer to the electrostatic latent image carrier body is maintained for a long period of time.

An electrophotograph development apparatus of the present invention for developing an electrostatic latent image formed on an electrostatic latent image carrier body with magnetic developer comprises a developer carrier body having a magnetic roller and a thin layer forming member for forming the magnetic developer on the developer carrier body into a thin layer in the inside thereof, in which a magnetic pole of the magnetic roller is disposed at a position of a $\theta$ degree of an upper stream side relative to a rotational direction of the developer carrier body from a contact point of the thin layer forming member with the developer carrier body so that a range of $\theta$ is within: 0 degree$\leqq\theta\leqq$10 degree.

Moreover, the electrophotograph development apparatus of the present invention has a relation between a surface roughness Rz' of the developer carrier body and a surface roughness Rz of the thin layer forming member being represented in the following equation:

$$-10\ \mu\text{m}\leqq(Rz-Rz')\leqq 5\ \mu\text{m}.$$

Furthermore, the electrophotograph development apparatus of the present invention for developing an electrostatic latent image formed on an electrostatic latent image carrier body with magnetic developer comprises a developer carrier body having a magnetic roller and a thin layer forming member for forming the magnetic developer on the developer carrier body into a thin layer in the inside thereof, in which a distance L from a contact point of the thin layer forming member with the developer carrier body to a free edge of the thin layer forming member is set so as to meet the following equation:

$$0<L\leqq(d/2)\times\tan\theta+k,\ 0\leqq k\leqq 1.5\ \text{mm},$$

where L denotes the distance, d an outer diameter of the developer carrier body and k a constant.

Still further, the electrophotograph development apparatus of the present invention for developing an electrostatic latent image formed on an electrostatic latent image carrier body with magnetic developer comprises a developer carrier body having a magnetic roller and a thin layer forming member for forming the magnetic developer on the developer carrier body into a thin layer in the inside thereof, in which a distance L from a contact point of the thin layer forming member with the developer carrier body to a free edge of the thin layer forming member is set so as to meet the following equation:

$$0<L\leqq(d/2)\times\tan\theta+k,\ 0\leqq k\leqq 1.5\ \text{mm},$$

where L denotes the distance, d an outer diameter of the developer carrier body and k a constant.

Yet further, the electrophotograph development apparatus of the present invention for developing an electrostatic latent image formed on an electrostatic latent image carrier body with magnetic developer comprises a developer carrier body having a magnetic roller and a thin layer forming member for forming the magnetic developer on the developer carrier body into a thin layer in the inside thereof, in which a distance L from a contact point of the thin layer forming member with the developer carrier body to a free edge of the thin layer forming member is set so as to meet the following equation:

$$0<L\leqq(d/2)\times\tan\theta,$$

where L denotes the distance, d an outer diameter of the developer carrier body.

In the present invention, a relation between the surface roughness Rz' of the developer carrier body, the surface roughness Rz of the thin layer forming member (Rz–Rz'), an angle θ degree of the contact point of the thin layer forming member and the developer carrier body and the magnetic pole position of the magnetic roller and the extrusion amount L of the thin layer forming member from the contact point of the thin layer forming member and the developer carrier body are set so as to meet proper conditions, thus it is possible to realize the uniformly thin layer formation, the uniform charging and the uniform suppliability of the magnetic developer on the developer carrier body, and to maintain a good printing quality for a long period of time. Specifically, the following three conditions must be satisfied.

(1) The relation between the surface roughness Rz' of the developer carrier body and the surface roughness Rz of the thin layer forming member shall be set so as to meet the following equation:

$$b-10\ \mu\text{m}\leqq(Rz-Rz')\leqq5\ \mu\text{m}.$$

(2) In the case where the magnetic pole N of the magnetic roller is disposed at the position of an angle of θ degree in the upper stream side relative to the sleeve rotational direction from the contact point A of the thin layer forming member and the developer carrier body, the magnetic pole N shall be disposed so as to meet $0\leqq\theta\leqq10$.

(3) The distance from the free edge C of the thin layer forming member to the contact point A of the developer carrier body and the thin layer forming member, that is, the extrusion amount L shall be set so as to meet the following equation:

$$0<L\leqq(d/2)\times\tan\theta+k,\ 0\leqq k\leqq1.5\ \text{mm},$$

(where d denotes the outer diameter of the developer carrier body, and k the constant. With the constant k=0, the more stabilized condition can be obtained.)

Thus, it is possible to realize the uniformly thin layer formation, the uniform charging and the uniform suppliability of the magnetic developer on the developer carrier body, and to maintain a good printing quality for a long period of time.

The developer carrier body is subjected to the blast processing or other processing for the purpose of controlling the JIS ten-point average roughness Rz thereof. (Hereinafter, the surface roughness of the developer carrier body 102 is referred to as Rz'.) In general, in comparison with the case where the surface of the developer carrier body is coated or subjected to other processing, accuracy thereof is easily administered, and a manufacturing cost thereof can be reduced.

Moreover, with regard to the above-described three conditions, a certain effect can be obtained by singly employing the respective conditions (1), (2) and (3) or employing the respective pairs of (1) and (2), (1) and (3) and (2) and (3). However, it is understood that the largest effect can be obtained by employing all of the conditions (1), (2) and (3).

BRIEF DESCRIPTION OF THE DRAWINGS

For a more complete understanding of the present invention and advantages thereof, reference is now made to the following description taken in conjunction with the accompanying drawings.

DETAILED DESCRIPTION OF THE PREFERRED EMBODIMENT

Descriptions will be made in detail for an embodiment of the present invention with reference to the accompanying drawings.

Figure 1:
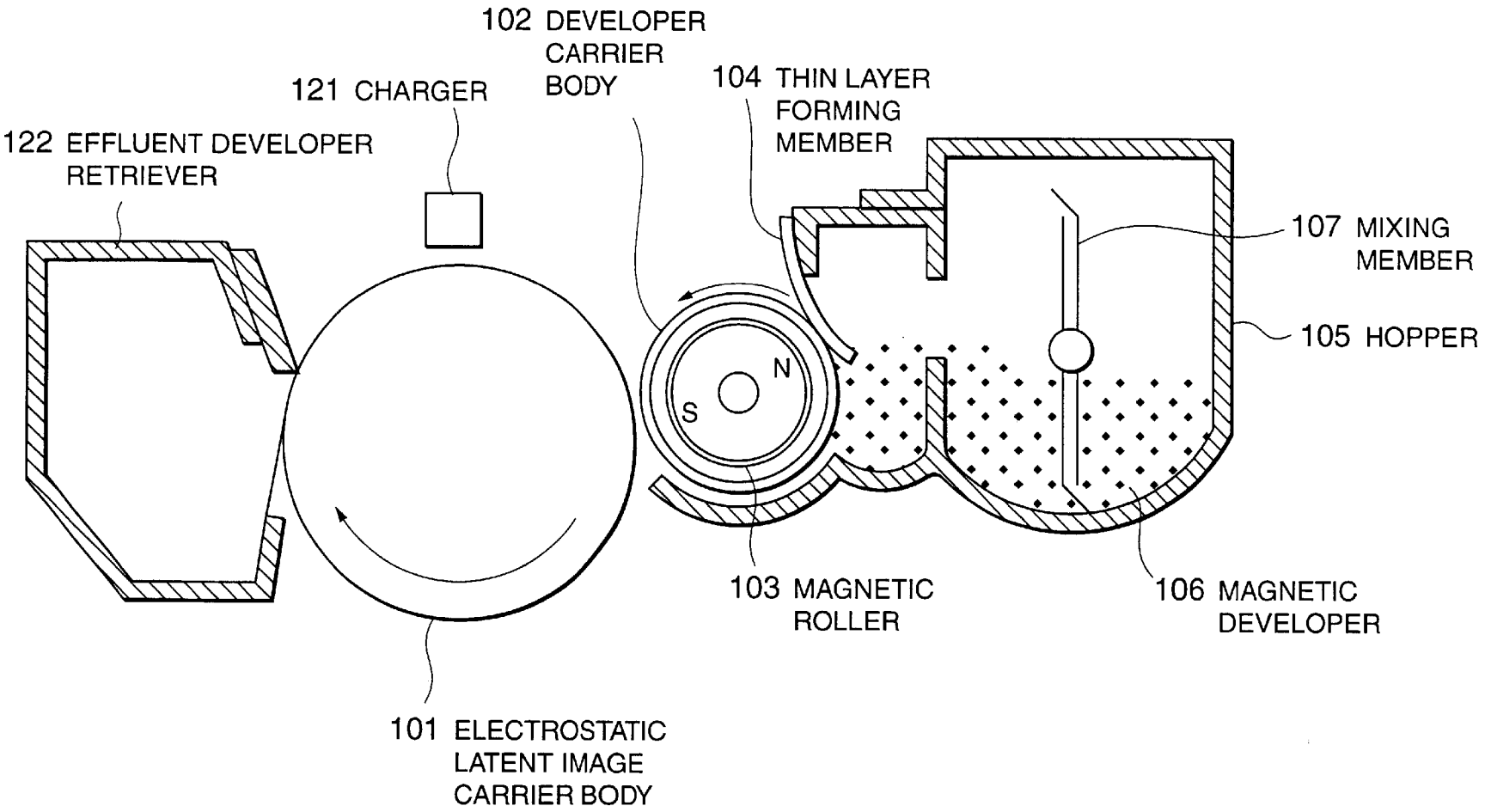
FIG. 1 is a typical cross-sectional view schematically showing an electrophotograph development apparatus.

FIG. 1 is a typical cross-sectional view schematically showing an electrophotograph development apparatus. In FIG. 1, the electrophotograph development apparatus comprises: an electrostatic latent image carrier body 101; a charger 121 for charging the electrostatic latent image carrier body 101 with static electricity for forming an electrostatic latent image; a developer carrier body 102 for developing the electrostatic latent image formed on the electrostatic latent image carrier body 101; a hopper 105 for supplying a specified amount of magnetic developer 106 on the developer carrier body 102; a thin layer forming member 104 for forming the magnetic developer 106 supplied on the developer carrier body 102 in to a uniformly thin layer; a magnetic roller 103 for assisting in supplying the magnetic developer 106 to the developer carrier body 102 and for developing a latent image on the electrostatic latent image carrier body 101 with the magnetic developer 106 formed to be a thin layer on the developer carrier body 102; and an effluent developer retriever 122 for retrieving unnecessary developer on the electrostatic latent image carrier body 101. A mixing member 107 is disposed inside the hopper 105, and the mixing member 107 mixes the magnetic developer 106.

The developer carrier body 102 rotates counterclockwise by an external driving device (not shown). And the magnetic developer 106 is supplied to the developer carrier body 102 with a magnetic force of the magnetic roller 103 disposed in a space closed by the developer carrier body 102, then the magnetic developer 106 is charged and formed into a uniformly thin layer with a friction of the thin layer forming member 104 and the developer carrier body 102. The magnetic developer 106, which is charged and formed into a thin layer on the developer carrier body 102, develops an electrostatic latent image on the electrostatic latent image carrier body 101. The thin layer forming member 104 is formed of an elastic material such as silicone rubber or polyurethane rubber, which has a hardness ranging from 30 to 75 degree specified in the JIS-A hardness. In this case, with regard to a line pressure relative to the developer carrier body 102, a range thereof from 3 to 250 (gf/mm) is effectively used.

The magnetic developer 106 is formed of polyester or styrene acrylic resin, which has an average particle diameter of 6 to 12 $\mu$m, an addition amount within the magnetic body of 40 to 200 parts, a holding power Hc of 50 to 150 and a residual magnetic flux density Br of 2 to 10 emu/g.

Figure 2:
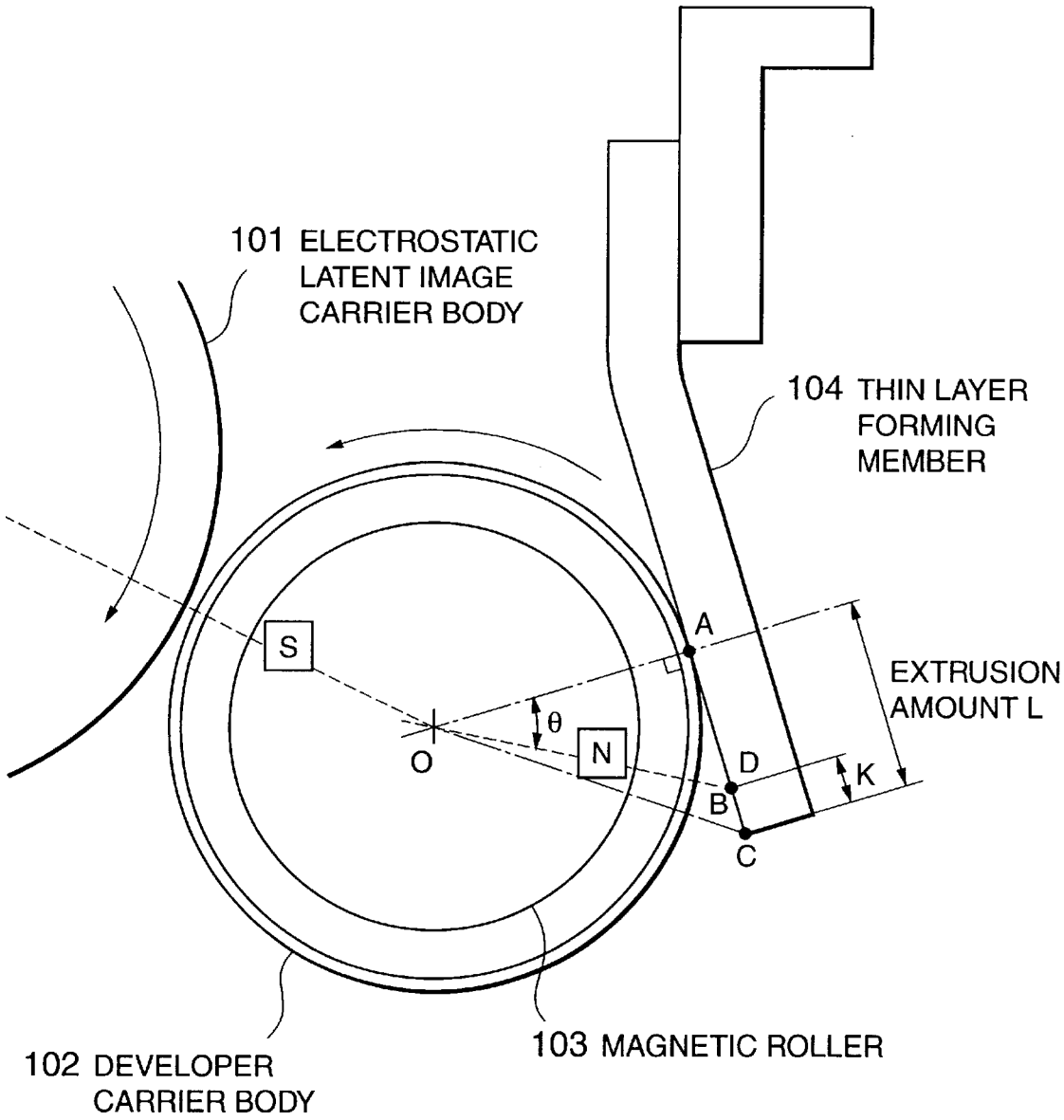
FIG. 2 is a cross sectional view showing a developer carrier body and the vicinity thereof.

FIG. 2 is a cross sectional view showing the developer carrier body 102 employed in the electrophotograph development apparatus of the first embodiment of the present invention and the vicinity thereof. The magnetic roller 103 has two magnetic poles: a magnetic pole N for supplying the developer 106 to the developer carrier body 102; and a magnetic pole S for developing the electrostatic latent image carrier body 101, the magnetic pole S being disposed at a proximal point relative to the electrostatic latent image carrier body 101.

An N pole of the magnetic roller 103 is disposed at a position of an angle of θ degree in an upper stream side relative to the sleeve rotational direction of the developer carrier body 102 from a contact point A of the thin layer forming member 104 and the developer carrier body 102, and the angle θ is set within a degree range from 0 to 10 ($0 \leqq \theta \leqq 10$). Moreover, a polarity of this magnetic pole does not depend on the N and S poles.

The developer carrier body 102 is formed of a material, for example, stainless steel, aluminum alloy and magnesium alloy, and the JIS ten-point average roughness of the surface of the developer carrier body 102 is controlled by subjecting the same to blast processing and the like.

The thin layer forming member 104 is formed of an elastic material such as silicone rubber and polyurethane rubber, which has a hardness ranging from 30 to 75 degree specified in the JIS-A hardness. In this case, the line pressure relative to the developer carrier body 102 is set within a range from 3 to 50 (gf/mm). Herein, a ten-point average roughness Rz of the surface contacting the developer carrier body 102 of the thin layer forming member 104 (hereinafter simply referred to as Rz) must be controlled by reflecting the same to an upper mold for forming rubber and by other means. And herein, the surface roughness Rz of the thin layer forming member 104 or the surface roughness Rz' of the developer carrier body 102 must be set so as to meet the following equation:

$$-10\ \mu m \leqq (Rz - Rz') \leqq 5\ \mu m \qquad \text{(equation 1).}$$

The above equation 1 indicates that Rz of the thin layer forming member 104 must be set larger when Rz' of the developer carrier body 102 is set larger. For example, in order to make a solid black density solider, it is effective that a carriage amount of the developer formed into a thin layer on the developer carrier body 102 is increased. In this case, it is considered effective that the surface roughness Rz' of the developer carrier body 102 is more roughened. In this case, if the surface roughness Rz of the thin layer forming member 104 is small, a chargeability of the developer is deteriorated. For this reason, the surface roughness Rz of the thin layer forming member 104 must be more roughened.

Moreover, with reference to FIG. 2, a relation among a distance from a free edge C of the thin layer forming member 104 to the contact point A of the developer carrier body 102 and the thin layer forming member 104, that is, an extrusion amount L (mm), an angle θ (degree) constituted of the contact point A of the developer carrier body 102 and the thin layer forming member 104, a rotation center O of the developer carrier body 102 and the N pole position of the magnetic roller 103 and a k value is represented by the following equation:

$$L = (d/2) \times \tan\theta + k \qquad \text{(equation 2),}$$

where d denotes an outer diameter of the developer carrier body 102, k a distance from an intersection D of an extending line O–N connecting the magnetic pole N of the magnetic roller 103 and the center O of the developer carrier body 102 and the thin layer forming member 104 to the free edge C of the thin layer forming member 104. And in consideration of a structure of the electrophotograph development apparatus of the present invention, at least L must be set larger than O. Therefore, the equation 2 is summarized as follows:

$$0 < L \leqq (d/2) \times \tan\theta + k \qquad \text{(equation 3).}$$

As described later, in order to enable a stable thin layer, L and θ are set so as to meet: $0 \leqq k \leqq 1.5$ mm.

Next, an operation of the first embodiment will be described below. In FIG. 1, the hopper 105 stores the magnetic developer 106. The magnetic developer 106 in the hopper 105 is mixed by the mixing member 107, and sent into a development chamber in which the development carrier body 102 is disposed. The magnetic developer 106 sent into the development chamber is supplied to the developer carrier body 102 with a magnetic force of the magnetic pole N of the magnetic roller 103. The developer carrier body 102 rotates counterclockwise by the external driving device (not shown), and then the magnetic developer 106 is charged and formed into a uniformly thin layer with the friction of the thin layer forming member 104 and the developer carrier body 102. The magnetic developer 106, which is charged and formed into a thin layer on the developer carrier body 102, develops an electrostatic latent image on the electrostatic latent image carrier body 101.

Uniforming levels of the chargeability and the thin layer of the magnetic developer 106 are decided with the surface roughness Rz' of the developer carrier body 102, the surface roughness Rz of the thin layer forming member 104 and a line pressure P relative to the developer carrier body 102 of the thin layer forming member 104.

Moreover, a suppliability of the magnetic developer 106 to the developer carrier body 102 is decided with a magnetic flux density of the magnetic pole N and a magnetic pole position θ of the magnetic roller 103 and the extrusion amount L of the thin layer forming member 104.

The present invention shows an ideal relation among the above-described parameters Rz, Rz', θ and L in order to improve the suppliability of the magnetic developer 106 to the developer carrier body 102 and the uniforming levels of the chargeability and the thin layer of the magnetic developer 106 on the developer carrier body 102. According to the present invention, a good printing quality can be maintained for a long period of time.

Next, a concrete embodiment will be described below. In this embodiment, an experiment is executed by use of an electrophotograph equipment having a process speed of 122 mm/sec. (equivalent to a printing speed of 26 ppm) to determine an effect of the first embodiment.

Figure 3:
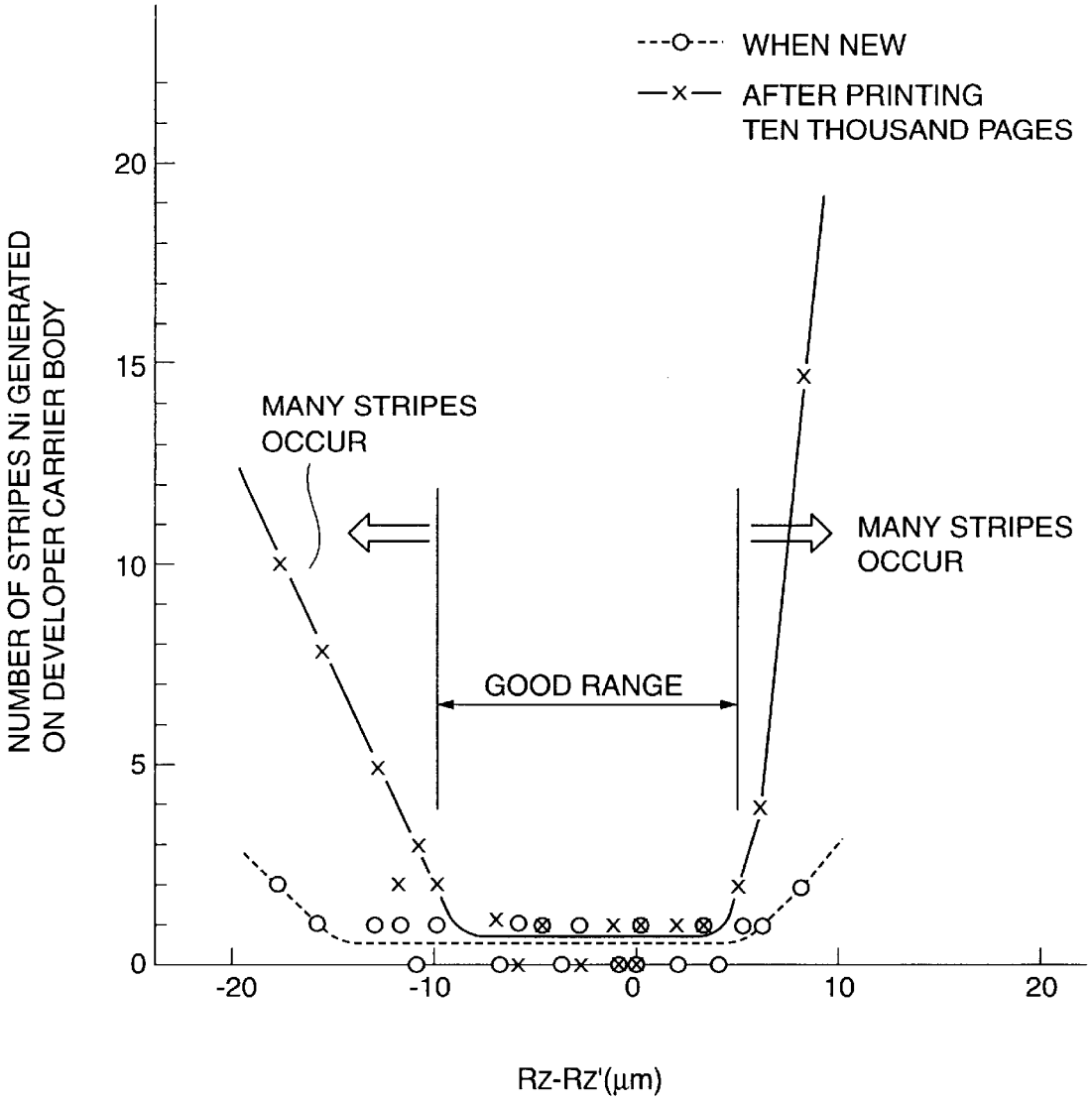
FIG. 3 is a graph showing an experimental result of a concrete embodiment.

(1) First, a relation between (Rz–Rz') and a number Ni of stripes generated on the developer carrier body 102 is shown in FIG. 3. Herein, Rz' denotes the surface roughness of the developer carrier body 102, and Rz denotes the surface roughness of the thin layer forming member 104. Moreover, that the Ni value is large means that a state of the developer thin layer is bad. In FIG. 3, an abscissa thereof shows (Rz–Rz'), and an ordinate thereof shows a number Ni of the stripes generated on the magnetic developer 106 formed into a thin layer on the developer carrier body 102. Evaluation is performed by means of confirming the state of the thin layer of the magnetic developer 106 by use of combinations of the thin layer forming members 104 having the surface roughnesses Rz of 2, 4, 8 and 10 μm and the developer carrier bodies 102 having the surface roughnesses Rz' of 2, 5, 8, 15 and 20 μm. At this time, θ indicating a position of the magnetic pole N of the magnetic roller 103 is fixed to 8 degree, and the extrusion amount L of the thin layer forming member 104 is fixed to 2.0 mm.

Results of the evaluation are described below. When the electrophotograph equipment is new, Ni is equal to 2 or less in a range (Rz–Rz') from −19 to 8 μm. From this result, it can be said that the electrophotograph equipment has a good tendency in printing quality. On the contrary to the above-described, when the electrophotograph equipment is used for performing printing for ten thousand pages, a range (Rz–Rz') showing a good state of the thin layer is narrowed into a range from −10 to 5 μm. From these results, it can be concluded that when a relation between the surface roughness Rz of the developer carrier body 102 and the surface roughness Rz' of the thin layer forming member 104 is set to meet the following equation:

$$-10\ \mu m \leqq (Rz-Rz') \leqq 5\ \mu,$$

this setting for Rz and Rz' is effective for forming the magnetic developer 106 on the developer carrier body 102 into a uniformly thin layer. Thus, printing defect problems such as lowering of a solid black density as printing is repeated, occurrence of a void, deterioration of density uniformity of printed dots and occurrence of white base fog can be solved.

Figure 4:
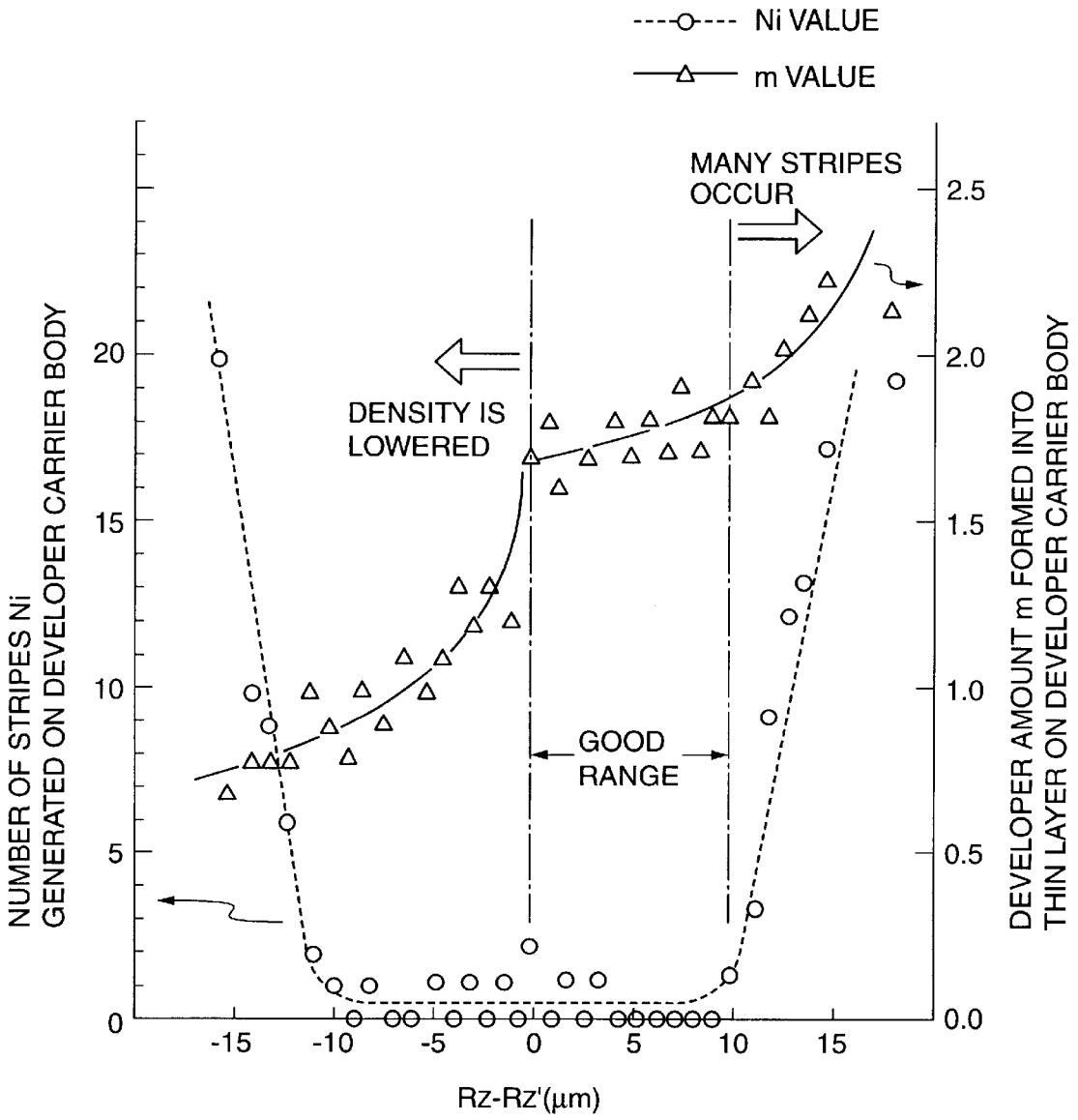
FIG. 4 is a graph showing an experimental result of a concrete embodiment.

(2) Next, relations among the N pole position θ of the magnetic roller 103 (see FIG. 2), a number Ni of stripes generated on the developer carrier body 102 and a magnetic developer amount m formed into a thin layer on the developer carrier body 102 are shown in FIG. 4. As described above, that the Ni value is large means that the state of the developer thin layer is bad. Moreover, the m value is one of the indexes showing a suppliability of the magnetic developer 106 to the developer carrier body 102. As the m value becomes larger, the white base fog is apt to occur. And as the m value becomes smaller, the solid black image density and the dot image density are apt to be lowered. In FIG. 4, an abscissa thereof shows the N pole position θ of the magnetic roller 103, and an ordinate thereof shows the number Ni of the stripes generated on the developer carrier body 102 and the magnetic developer amount m formed into a thin layer on the developer carrier body 102. Evaluation is performed by means of measuring the number Ni of the stripes generated on the developer carrier body 102 and the magnetic developer amount m formed into a thin layer on the developer carrier body 102 by fixing the surface roughness Rz of the thin layer forming member 104 to 2 μm, the surface roughness Rz' of the developer carrier body 102 to 5 μm and the extrusion amount L of the thin layer forming member 104 to 2.0 mm and by varying the N pole position θ of the magnetic roller 103.

Results of the evaluation are described below. The Ni value is equal to 2 or less in a range of θ from −10 to 10 degree, which can be judged as good. However, the m value is lowered than 1.50 mg/cm$^2$ with θ less than 0 degree, the lowering is drastic from this point and the solid black image density is also lowered. From these results, it can be concluded that in the case where the magnetic pole N of the magnetic roller 103 is disposed at the position of an angle of θ degree in the upper stream side relative to the sleeve rotational direction from the contact point A of the thin layer forming member 104 and the developer carrier body 102, by disposing the magnetic pole N so as to meet 0<θ<10, the suppliability of the magnetic developer 106 to the developer carrier body 102 is stabilized, and further the magnetic developer 106 on the developer carrier body 102 is effectively formed into a uniformly thin layer. Thus, printing defect problems such as lowering of a solid black density, occurrence of a void, deterioration of density uniformity of printed dots and occurrence of white base fog can be solved.

Figure 5:
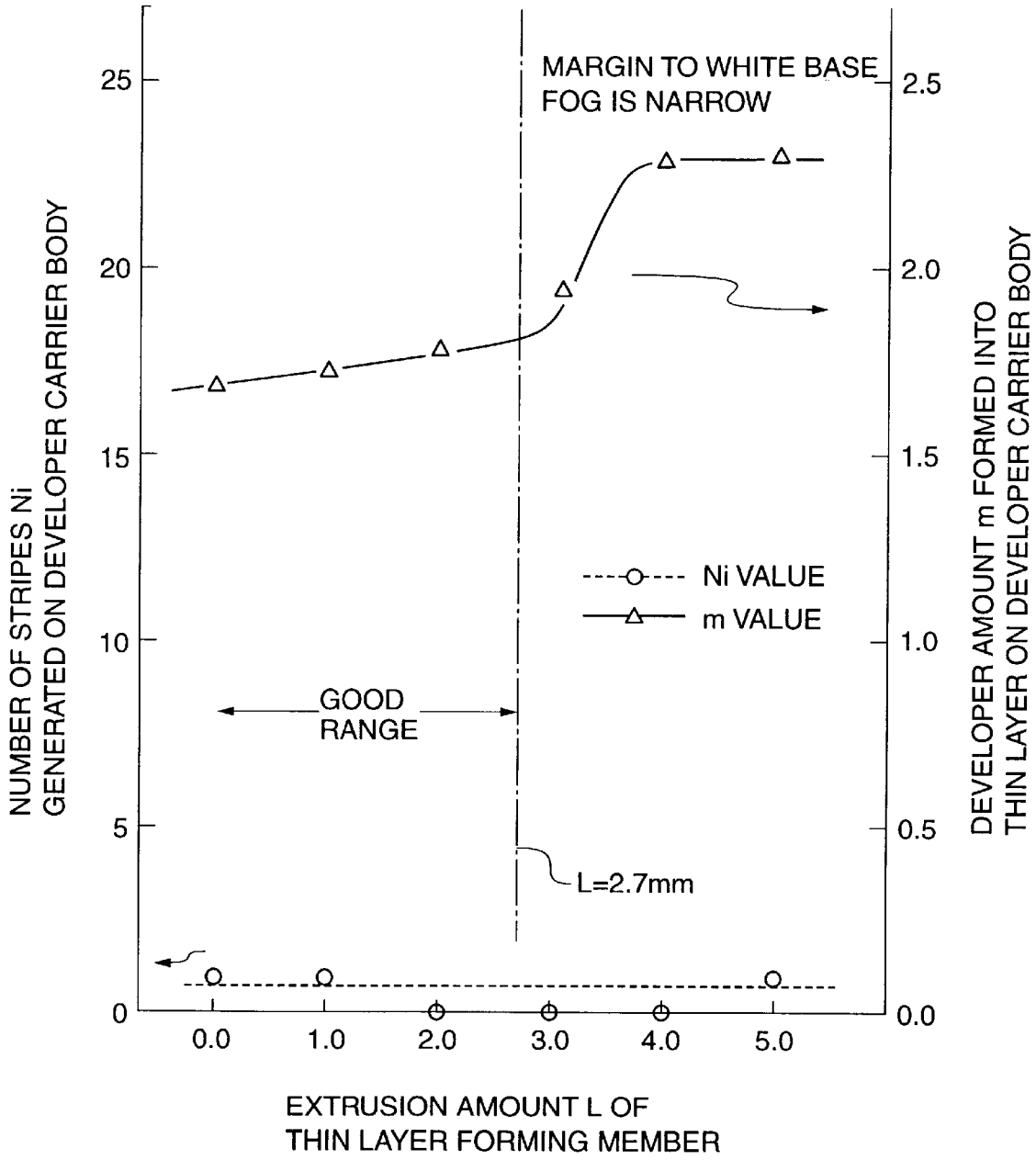
FIG. 5 is a graph showing an experimental result of a concrete embodiment.

(3) Next, relations among the extrusion amount L of the thin layer forming member 104 (see FIG. 2), the number Ni of stripes generated on the developer carrier body 102 and the magnetic developer amount m formed into a thin layer on the developer carrier body 102 are shown in FIG. 5. Descriptions for the Ni and m values are the same as described above and omitted here. In FIG. 5, an abscissa thereof shows the extrusion amount L of the thin layer forming member 104, and an ordinate thereof shows the number Ni of the stripes generated on the developer layer formed into a thin layer on the developer carrier body 102 and the magnetic developer amount m formed into a thin layer on the developer carrier body 102. Evaluation is performed by means of measuring (he number Ni of the stripes generated on the developer carrier body 102 and the magnetic developer amount m formed into a thin layer on the developer carrier body 102 by fixing the surface roughness Rz of the thin layer forming member 104 to 2 μm, the surface roughness Rz' of the developer carrier body 102 to 5 μm, the outer diameter d to 20 mm, the N pole position θ of the magnetic roller 103 to 7 degree and the line pressure of the thin layer forming member 104 to 10 gf/mm and varying the extrusion amount L to 0, 1, 2, 3, 4 and 5 mm. Results of the evaluation are described below. With reference to FIG. 5, it can be understood that the Ni value hardly depends on the L value. On the other hand, when L>4, the m value is: m>2.0 mg/cm$_2$, thus easily causing the white base fog. This m value is radically increased from the boundary in which L is equal to about 2 to 3 mm, and an inflection point thereof can be seen to be a point in which L is equal to about 2.7 mm. Herein, when θ=7 degree and d=20 mm, which are conditions of this experiment, are substituted in the equation 2 and calculation is performed, (L–K)=1.2 mm is obtained. Moreover, when the above-described inflection point L=2.7 mm is substituted therein and calculation is performed, k=1.5 is obtained. Specifically, it can be considered that there exists no problem regarding a setting value of the extrusion amount L of the thin layer forming member 104 if the following conditions are satisfied:

$$0 < L \leqq (d/2) \times \tan\theta + k,\ k \leqq 1.5\ \text{mm}.$$

In order to set a more stab-lived condition, the constant k: may be set equal to 0. From these results, it can be concluded that the distance from the free edge C of the thin layer forming member 104 to the contact point A of the developer carrier body 102 and the thin layer forming member 104, that is, the extrusion amount L, and the angle θ may be set so as to meet the following equation:

$$0 < L \leqq (d/2) \times \tan\theta + k,\ 0 \leqq k \leqq 1.5\ \text{mm.},$$

(where d denotes the outer diameter of the developer carrier body 102, and k a constant. With the constant k=0, the more stabilized condition can be obtained.), thus the suppliability of the magnetic developer 106 to the developer carrier body 102 is stabilized, and further the magnetic developer 106 on the developer carrier body 102 is effectively formed into a uniformly thin layer.

In this case, the magnetic developer 106 is supplied to the developer carrier body 102 by the N pole of the magnetic roller 103, thus it is possible to prevent an excessive supply of the magnetic developer 106 to a space closed with points A, B and C shown in FIG. 2 and it is possible to stably form the magnetic developer 106 into a thin layer with the thin layer forming member 106. Moreover, by setting L under the condition of the constant k equal to 0, the largest effect can be obtained.

Thus, printing defect problems such as lowering of a solid black density, occurrence of a void, deterioration of density uniformity of printed dots and occurrence of white base fog can be solved.

This embodiment thus described may be summarized as follows. First, the following three conditions must be satisfied.

(1) The relation between the surface roughness Rz' of the developer carrier body 102 and the surface roughness Rz of the thin layer forming member 104 shall be set so as to meet the following equation:

$$-10\ \mu m \leqq (Rz-Rz') \leqq 5\ \mu m.$$

(2) In the case where the magnetic pole N of the magnetic roller 103 is disposed at the position of an angle of θ degree in the upper stream side relative to the sleeve rotational direction from the contact point A of the thin layer forming member 104 and the developer carrier body 102, the magnetic pole N shall be disposed so as to meet $0 \leqq \theta \leqq 10$.

(3) The distance from the free edge C of the thin layer forming member 104 to the contact point A of the developer carrier body 102 and the thin layer forming member 104, that is, the extrusion amount L shall be set so as to meet the following equation:

$$0 < L \leqq (d/2) \times \tan\theta + k,\ 0 \leqq k \leqq 1.5\ \text{mm},$$

(where d denotes the outer diameter of the developer carrier body 102, and k the constant. With the constant k=0, the more stabilized condition can be obtained.)

Thus, it is possible to realize the uniformly thin layer formation, the uniform charging and the uniform suppliability of the magnetic developer 106 on the developer carrier body 102, and to maintain a good printing quality for a long period of time.

The developer carrier body 102 is subjected to the blast processing or other processing for the purpose of controlling the JIS ten-point average roughness Rz thereof. In general, in comparison with the case where the surface of the developer carrier body 102 is coated or subjected to other processing, accuracy thereof is easily administered, and a manufacturing cost thereof can be reduced.

Moreover, with regard to the above-described three conditions, a certain effect can be obtained by singly employing the respective conditions (1), (2) and (3) or employing the respective pairs of (1) and (2), (1) and (3) and (2) and (3). However, it is understood that the largest effect can be obtained by employing all of the conditions (1), (2) and (3).

Figure 6:
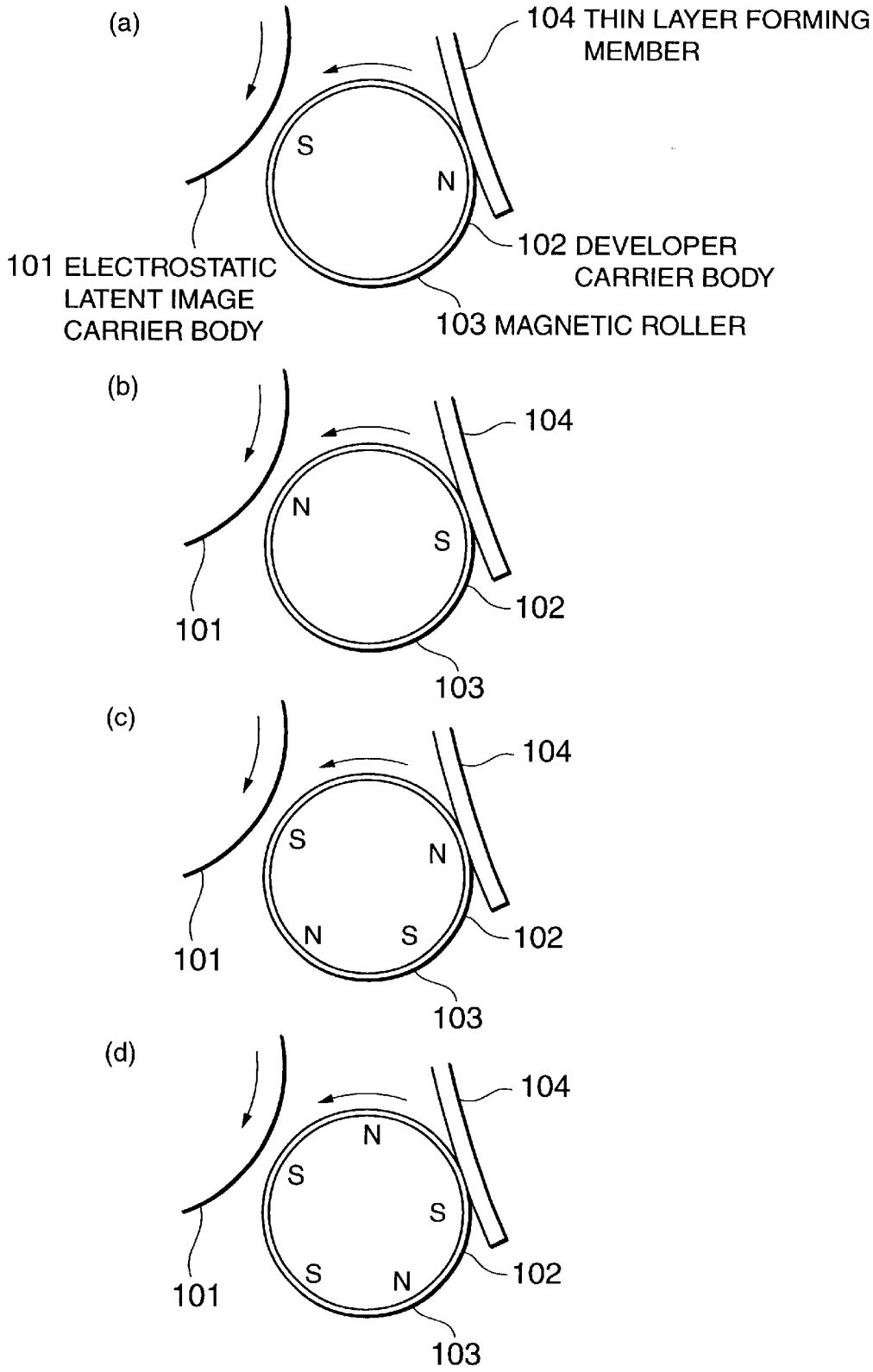
FIGS. 6(*a*) to 6(*d*) are explanatory views showing magnetic pole positions of a magnetic roller.

Next, a second embodiment of the present invention will be described below. In the first embodiment, only the case of the magnetic roller 103 having a two-pole structure as shown in FIG. 2 has been described. However, as shown in FIGS. 6(*a*) and 6(*b*), it does not matter that each of the magnetic poles of the magnetic roller 103 is S or N. Moreover, the number of the magnetic poles may be satisfactorily two or more, and as shown in FIGS. 6(*c*) and 6(*d*), the magnetic rollers 103 having a four-pole structure and a five-pole structure may be used.

Figure 7:
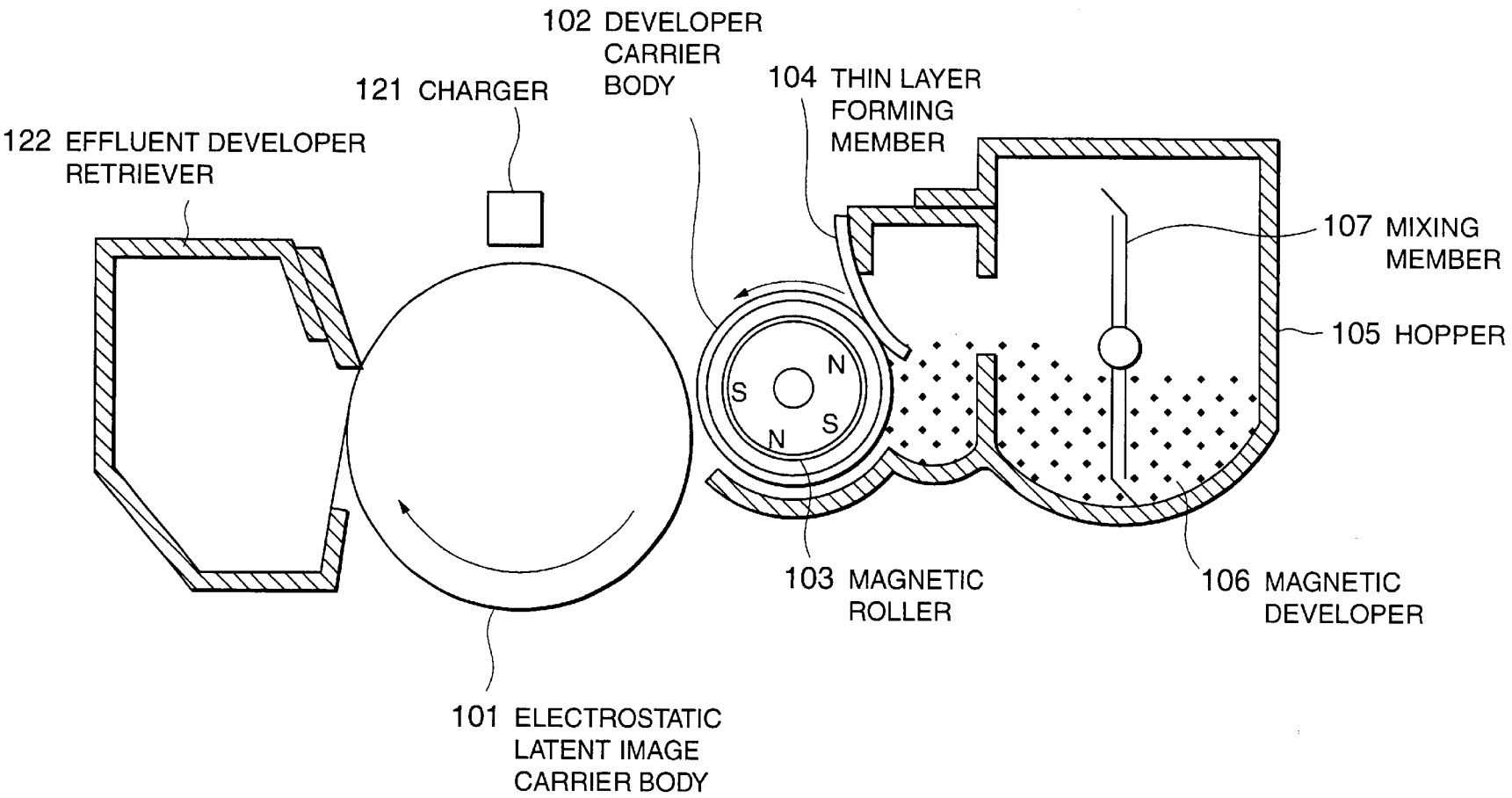
FIG. 7 is a cross-sectional view of a second embodiment.

FIG. 7 is a cross-sectional view of the second embodiment. FIG. 7 shows the case where the number of the magnetic poles of the magnetic roller 103 is four. Although it has been shown in FIG. 6, it does not make any difference that each of the magnetic poles of the magnetic roller 103 is S or N. Moreover, the number of the magnetic poles may be four, five or more. Specifically, the surface roughness Rz' of the developer carrier body 102, the surface roughness Rz of the thin layer forming member 104, the extrusion amount L of the thin layer forming member 104 and the magnetic pole position θ positioned at the upper stream of the contact point A of the thin film forming member 104 and the developer carrier body 102 of the magnetic roller 103 are properly adjusted, thus performing optimal supplying, thin layer forming and charging of the magnetic developer 106.

The operation and the effect of the second embodiment are the same as those of the first embodiment.

Next, a third embodiment of the present invention will be described below. In the first embodiment, the case where the developer carrier body 102 for developing an electrostatic latent image formed on the electrostatic latent image carrier body 101 is only subjected to blast processing for the purpose of controlling the JIS ten-point average roughness Rz has been described. In the third embodiment, for increasing a surface-wearing resistant property of the developer carrier body 102 and improving an image quality, the surface of the developer carrier body 102 is subjected to non-electric field nickel plating and other coating, thus on the surface of the developer carrier body 102, a dielectric layer or a conductive layer is provided.

Also with such a constitution, an effect similar to that of the first embodiment can be obtained.

Although the preferred embodiments of the present invention have been described in detail, it should be understood that various changes, substitutions and alternations can be made therein without departing from spirit and scope of the inventions as defined by the appended claims.

What is claimed is:

1. An electrophotograph development apparatus for developing an electrostatic latent image formed on an electrostatic latent image carrier body with magnetic developer, comprising:

a developer carrier body having a magnetic roller; and a thin layer forming member for forming said magnetic developer on said developer carrier body into a thin layer, wherein a magnetic pole of said magnetic roller is disposed at a position of a θ degree in an upper stream side relative to a rotational direction of said developer carrier body from a contact point of said thin film forming member and said developer carrier body, and θ meets: 0 degree$\leqq\theta\leqq$10 degree, wherein a relation between a surface roughness Rz' of said developer carrier body and a surface roughness Rz of said thin layer forming member is represented in the following equation:

$$-10\ \mu m \leqq (Rz-Rz') \leqq 5\ \mu m.$$

2. An electrophotograph development apparatus for developing an electrostatic latent image formed on an electrostatic latent image carrier body with magnetic developer, comprising:

a developer carrier body having a magnetic roller; and a thin layer forming member for forming said magnetic developer on said developer carrier body into a thin layer, wherein a distance L from a contact point of said thin layer forming member with said developer carrier body to a free edge of said thin layer forming member is set so as to meet the following equation:

$$0<L\leqq(d/2)\times\tan\theta+k,\ 0\leqq k\leqq 1.5\ \text{mm},$$

where L denotes the distance, d an outer diameter of said developer carrier body, k a constant, and θ is an angle formed by a magnetic pole of said magnetic roller disposed at a position in an upper stream side relative to a rotational direction of said developer carrier body from a contact point of said thin film forming member and said developer carrier body.

3. An electrophotograph development apparatus for developing an electrostatic latent image formed on an electrostatic latent image carrier body with magnetic developer, comprising:

a developer carrier body having a magnetic roller; and a thin layer forming member for forming said magnetic developer on said developer carrier body into a thin layer, wherein a magnetic pole of said magnetic roller is disposed at a position of a θ degree in an upper stream side relative to a rotational direction of said developer carrier body from a contact point of said thin film forming member and said developer carrier body, and θ meets: 0 degree≦θ≦10 degree, and wherein a distance L from a contact point of said thin layer forming member with said developer carrier body to a free edge of said thin layer forming member is set so as to meet the following equation:

$$0<L\leqq(d/2\times\tan\theta+k,\ 0\leqq k\leqq 1.5\ \text{mm},$$

where L denotes the distance, d an outer diameter of said developer carrier body and k a constant.

4. An electrophotograph development apparatus for developing an electrostatic latent image formed on an electrostatic latent image carrier body with magnetic developer, comprising:

a developer carrier body having a magnetic roller; and a thin layer forming member for forming said magnetic developer on said developer carrier body into a thin layer, wherein a distance Ii from a contact point of said thin layer forming member with said developer carrier body to a free edge of said thin layer forming member is set so as to meet the following equation:

$$0<L\leqq(d/2)\times\tan\theta,$$

where L denotes the distance, d an outer diameter of said developer carrier body, and θ is an angle formed by a magnetic pole of said magnetic roller disposed at a position in an upper stream side relative to a rotational direction of said developer carrier body from a contact point of said thin film forming member and said developer carrier body.

5. An electrophotograph development apparatus for developing an electrostatic latent image formed on an electrostatic latent image carrier body with magnetic developer, comprising:

a developer carrier body having a magnetic roller; and a thin layer forming member for forming said magnetic developer on said developer carrier body into a thin layer, wherein a magnetic pole of said magnetic roller is disposed at a position of a θ degree in an upper stream side relative to a rotational direction of said developer carrier body from a contact point of said thin film forming member and said developer carrier body, and θ meets: 0 degree≦θ≦10 degree, and wherein a distance L from a contact point of said thin layer forming member with said developer carrier body to a free edge of said thin layer forming member is set so as to meet the following equation:

$$0<L\leqq(d/2)\times\tan\theta,$$

where L denotes the distance, d an outer diameter of said developer carrier body.

6. The electrophotograph development apparatus according to claim 1, wherein said magnetic developer is one component developer.

7. The electrophotograph development apparatus according to claim 1, wherein said magnetic developer carrier body is subjected to blast processing.

8. The electrophotograph development apparatus according to claim 1, wherein a surface of said magnetic developer carrier body has a dielectric layer.

9. The electrophotograph development apparatus according to claim 1, wherein a surface of said magnetic developer carrier body has a conductive layer.

10. The electrophotograph development apparatus according to claim 1, wherein said magnetic roller has two or more magnetic poles.

11. The electrophotograph development apparatus according to claim 1, wherein said electrophotograph development apparatus develops an electrostatic latent image formed on an electrostatic latent image carrier body with magnetic developer, further comprises a developer carrier body having a magnetic roller and a thin layer forming member for forming said magnetic developer on said developer carrier body into a thin layer in the inside thereof, and a distance L from a contact point of said thin layer forming member with said developer carrier body to a free edge of said thin layer forming member is set so as to meet the following equation:

$$0<L\leqq(d/2)\times\tan\theta+k,\ 0\leqq k\leqq 1.5\ \text{mm},$$

where L denotes the distance, d an outer diameter of said developer carrier body and k a constant.

12. The electrophotograph development apparatus according to claim 1, wherein said electrophotograph development apparatus develops an electrostatic latent image formed on an electrostatic latent image carrier body with magnetic developer, further comprises a developer carrier body having a magnetic roller and a thin layer forming member for forming said magnetic developer on said developer carrier body into a thin layer in the inside thereof, and a distance L from a contact point of said thin layer forming member with said developer carrier body to a free edge of said thin layer forming member is set so as to meet the following equation:

$$0<L\leqq(d/2)\times\tan\theta,$$

where L denotes the distance, d an outer diameter of said developer carrier body.

* * * * *